US007089877B1

(12) United States Patent
Hay

(10) Patent No.: US 7,089,877 B1
(45) Date of Patent: Aug. 15, 2006

(54) STANDOFF MOORING BAR

(76) Inventor: Duff M. Hay, 1509 Lake Holiday Dr., Sandwich, IL (US) 60548

( * ) Notice: Subject to any disclaimer, the term of this patent is extended or adjusted under 35 U.S.C. 154(b) by 0 days.

(21) Appl. No.: 11/296,896

(22) Filed: Dec. 9, 2005

(51) Int. Cl.
*B63B 21/00* (2006.01)

(52) U.S. Cl. ..... 114/230.17; 114/221 R

(58) Field of Classification Search ..... 114/230.1, 114/230.11, 230.15–230.19, 230.02, 230.27, 114/219, 221 R, 249, 250; 280/490.1, 491.1, 280/491.2; 403/109.1, 109.7, 109.8
See application file for complete search history.

(56) References Cited

U.S. PATENT DOCUMENTS 3,224,404 A * 12/1965 De Jong ..... 114/230.25
3,406,651 A * 10/1968 Jalbert ..... 114/230.17
4,708,083 A * 11/1987 Billings ..... 114/230.17
4,781,138 A * 11/1988 Hay ..... 114/221 R
4,977,846 A * 12/1990 Landa et al. ..... 114/230.17
5,046,442 A * 9/1991 Hay ..... 114/230.17
5,398,634 A * 3/1995 Eagan ..... 114/230.1
6,928,945 B1 * 8/2005 Tebo, Jr. ..... 114/230.15

* cited by examiner

*Primary Examiner*—Ajay Vasudeva

(57) ABSTRACT

A standoff mooring bar for a vehicle such as a boat or a floating aircraft featuring an adjustable mooring bar body that is automatically locked at the desired mooring length when a guying rope and a mooring rope are tensioned. This body has an inner cylindrical tube telescoping within an outer cylindrical tube, and a pair of end caps closing the telescoping pair of tubes. The mooring rope extends through the pair of tubes by passing through openings located in both end caps. An automatic locking mechanism fixes the adjustable length of the telescoping pair of tubes when the tie ends of the mooring rope and guying rope are secured during mooring. When used in pairs on a craft, the guying ropes maintain the craft from moving forward or backward parallel to the docking structure; the locked telescoping tubes keep the craft from hitting and rubbing against the docking structure, or from moving away perpendicularly.

4 Claims, 3 Drawing Sheets

STANDOFF MOORING BAR

CROSS REFERENCE TO RELATED PATENTS

| Pat. # | Date Issued | Inventor | Classification |
|---|---|---|---|
| 3,062,169 | November 1962 | Cook | 114/230. |
| 3,199,818 | August 1965 | Ahara | 403/109. |
| 3,741,514 | June 1973 | Snurr | 403/377. |
| 4,781,138 | November 1988 | Hay | 114/230. |
| 4,977,846 | December 1990 | Landa | 114/230. |
| 5,014,638 | May 1991 | Ilves | 114/230. |
| 5,046,442 | September 1991 | Hay | 114/230. |
| 5,398,634 | March 1995 | Eagan | 114/230. |
| 5,634,421 | June 1997 | Velarde | 114/230. |
| 6,145,461 | November 2000 | VanAssche | 114/230. |
| 6,422,169 | July 2002 | Schwantes | 114/230. |
| 6,561,113 | May 2003 | Leise | 114/230. |

BACKGROUND OF THE INVENTION

It is commonplace to moor a vehicle such as a boat or floating aircraft to a dock or to another vehicle. Water traffic or severe weather conditions, such as rough water or turbulent winds can buffet the vehicle excessively causing damage, or even loss of the vehicle. This invention relates to a telescoping bar for vehicles such as a boat which can be adjusted to moor a boat at various distances from a dock or to another craft and which is automatically locked at the adjusted length for mooring when the mooring and guying ropes are taut.

The prior art relating to devices for mooring a boat is extensive. This art includes bumpers or fenders which may be attached either to the boat or to a dock to prevent the boat from being damaged by hitting against the dock due to the action of wind and waves. However, these bumpers rub and scuff the boat often causing moderate but permanent damage to the boat.

Accordingly, mooring devices were developed which separate the boat from the structure to which it is moored. Most of these devices employ a rigid elongated body which is used as a separating bar to cause a boat to standoff from its dock. U.S. Pat. Nos. 2,938,492, 3,224,404, 3,863,591, 3,878,808, 5,398,634, 5,634,421, and 6,561,113 disclose typical structures having bars of constant length. U.S. Pat. Nos. 2,558,174, 3,406,651, 4,977,846, and 5,014,638 disclose mooring devices of several, discrete varying lengths produced by telescoping one element within another. However, these telescoping bars are not infinitely adjustable within the minimum and maximum lengths. Additionally, they are cumbersome to apply in certain docking situations. U.S. Pat. Nos. 6,145,461 and 6,422,169 require special attachments to the craft and are also of constant length.

The inventor's U.S. Pat. No. 5,046,442 discloses a standoff mooring bar which is infinitely variable between minimum and maximum lengths. This mooring bar employs an internal locking assembly to fix the adjustable length of a telescoping pair of tubes, however, the internal locking assembly utilizes a flexible rope affixed to the inner telescoping cylindrical tube. This connection to the inner cylindrical tube is more susceptible to failure which could cause collapse of the mooring bar and subsequent damage to the craft than is the proposed invention. This prior art also requires a separate guy rope whereas the new invention employs the continuation of the flexible locking rope as it passes outside the mooring bar becoming the guying rope thus eliminating the extra, separate rope and susceptible connection therein.

SUMMARY OF THE INVENTION

Accordingly, a principal object of this invention is to provide a simple mooring bar, which is easy to apply, which can be manually adjusted to any length between its minimum and maximum limits of length, and which is automatically locked at the manually adjusted length.

Another object is to increase the ability of an infinitely adjustable mooring bar to withstand forces developed during mooring which would otherwise alter the length of the mooring bar by collapsing or extending the bar.

A preferred embodiment of the standoff mooring bar of this invention features an inner cylindrical tube telescoping within an outer cylindrical tube. Both ends of the telescoping pair of tubes are closed by end caps. A single length of mooring rope passes through the composite bore defined by both tubes with a tie end emerging from a hole located in each end cap.

An automatic locking assembly fixes the adjustable length of the telescoping pair of tubes when the tie ends of the mooring rope and the guying rope are secured during mooring. Two methods are described herein and are claimed within this specification, however, does not preclude other methods of achieving these stated performance capabilities. This locking mechanism utilizes the guying rope as a locking rope internally into which the mooring rope passes into (creating a composite portion of the central mooring rope which terminates coterminously externally). This locking rope then runs along the outside of the inner cylindrical tube and out through a hole in the outer cylindrical tube to become the guying rope. When the composite portion of the central mooring rope passes through the outer cylindrical tube end cap, a third cylindrical locking tube is included which is located concentrically within the outer and inner cylindrical tubes and terminates at the outer cylindrical tube end cap internally. The guying/locking rope separates from the composite portion of the central mooring rope once inside the assembly, is routed around the end of the locking tube, around the internal end of the inner cylindrical tube, exiting through the outer cylindrical tube to become the guying rope externally. As an alternate method, if the composite portion of the central mooring rope passes through the inner cylindrical tube end cap, a third cylindrical locking tube is not required. The guying/locking rope separates from the composite portion of the central mooring rope inside the assembly, is routed around the internal end of the inner cylindrical tube, exiting through the outer cylindrical tube to become the guying rope externally.

When the tie ends of the mooring rope and guying rope are tensioned and secured during mooring after the telescoping tubes are adjusted to the proper standoff distance, the tubes are automatically locked against collapsing or extending at the required distance. No manual insertion of lock pins or the rotation of locking parts is required.

The guying rope, which prevents swaying of a vehicle to which a pair of mooring bars are attached, is routed through a hole in the wall of the outer tube and through the inner tube. As the overall length of the telescoping tubes increases, the length of guy rope routed around the end of the inner tube of the mooring bar decreases thereby increasing the length of guy rope available to secure to the dock. The guying force in the guying rope enhances the locking forces. With both mooring bars tensioned and taut, relaxation of the guying rope tension in either mooring bar is minimal thus maintaining the locking length of both mooring bars.

The locking rope becoming the guying rope is a distinct difference from prior art. Instead of the mooring rope providing locking tension in the prior art, the guying rope provides the locking tension. The strength of the locking technique in prior art is also dependent on the terminations of two separate ropes; the strength of the proposed design locking technique relies only upon the superior inherent strength of a single continuous rope in tension with no terminations. Simplification, strength and reliability are improved.

A principal difference of the present design over that covered in the inventor's U.S. Pat. No. 5,046,442 is elimination of a separate guying rope and a separate locking rope each with terminations which could fail causing failure of the assembly to maintain its adjusted length. It relied on the strength of the separate terminations of the guying rope and locking rope which are less than the breaking strength of the continuous guying/locking rope in tension. The present design utilizes the continuation of the guying rope as the locking rope with no terminations other than at tie offs at docking rings. This provides for a more reliable and stronger locking mechanism. The compression locking assembly of U.S. Pat. No. 5,046,442 has a more limited force that can be withstood in compression due to the terminations described above. The present design can work in conjunction with the compression locking assembly of U.S. Pat. No. 4,781,138 (not shown), or entirely by itself. The locking strength in compression of the new design is based on the breaking strength of the guying/locking rope in tension; the locking strength in tension relies on the breaking strength of the mooring rope in tension.

The operation and ease of use of the new locking design of this specification is simple. Fabrication and assembly of this new automatic locking design is simplified thereby reducing manufacturing costs and increasing afford ability. Utilizing the automatic locking feature of this invention, the diameters of the telescoping tubes are not limited by having either standard or custom molded locking assemblies which dictate the diameters; any size tubes which allows insertion within each other with clearance for the locking rope can be utilized. Larger diameter tubes and ropes with higher strengths for larger vehicles can be accommodated easily with the new design of this invention.

VIEWS OF THE DRAWINGS

In order that all of the structural features for attaining the objects of this invention may be readily understood, reference is made to the accompanying drawings in which.

DETAILED DESCRIPTION OF THE DRAWINGS

Figure 1:
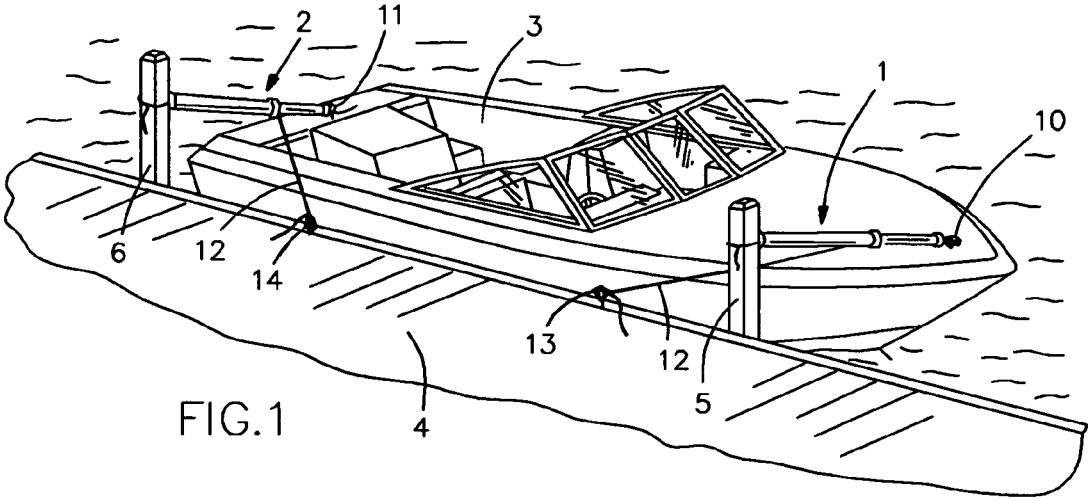
FIG. 1 is a perspective view showing the application to a boat of a pair of the standoff mooring bars of this invention.
Figure 2:
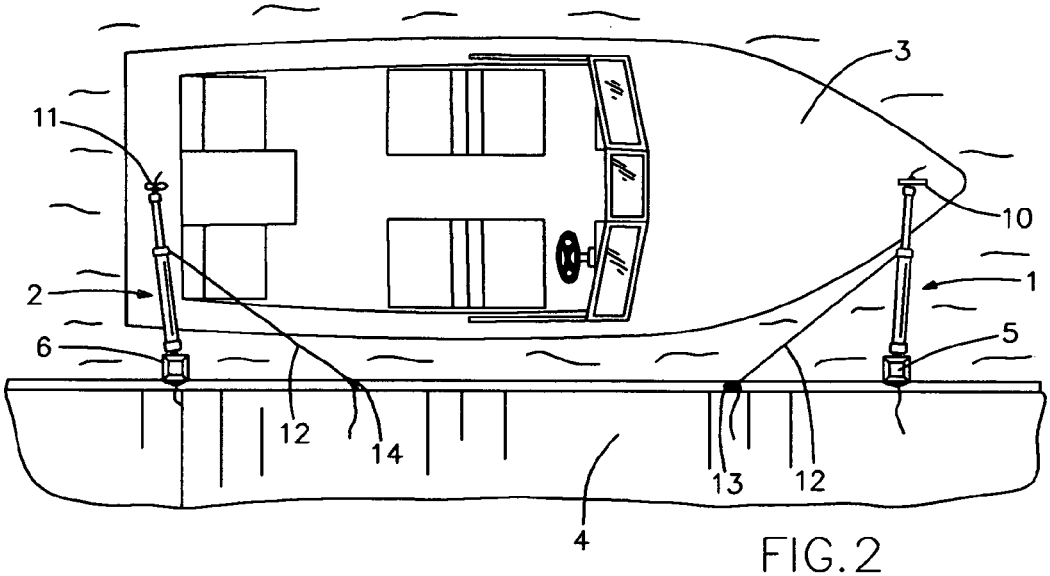
FIG. 2 is a plan view of the structure of FIG. 1.
Figure 3:
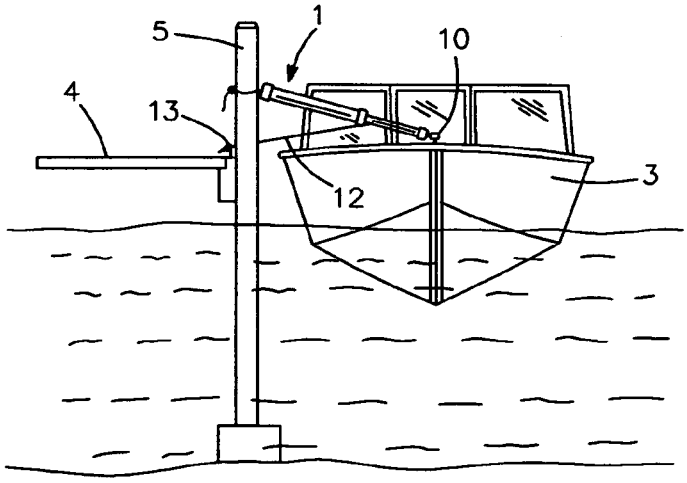
FIG. 3 is a bow end view of the structure of FIGS. 1 and 2.

FIGS. 1–3 of the drawings show a typical application of a pair of standoff mooring bars 1 and 2 of this invention in securing boat 3 to a dock 4 and a pair of docking posts 5 and 6.

Each mooring bar 1 and 2 is adjustable in length to provide a standoff distance which moors boat 3 out of contact with dock 4 to avoid damaging the hull of the boat.

Figure 4:
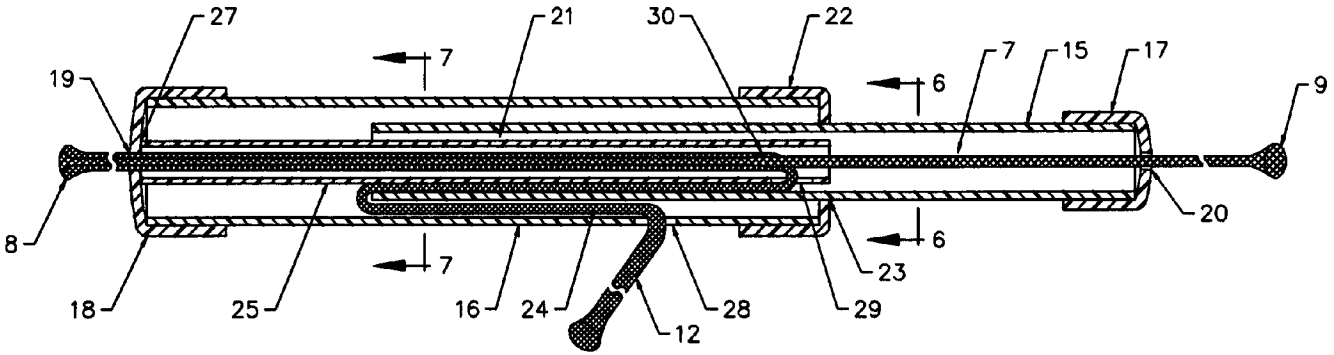
FIG. 4 is a section view of a single standoff mooring bar of this invention in an extended adjustment with an internal locking tube.
Figure 5:
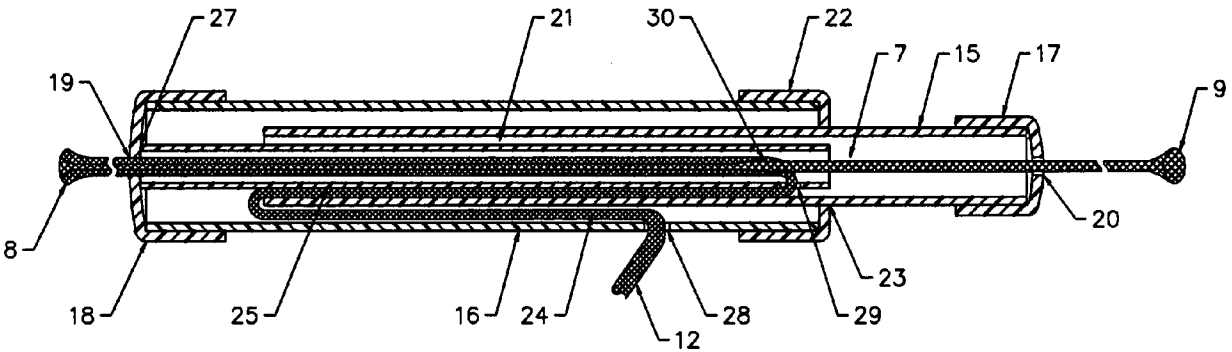
FIG. 5 is a section view which shows the structure of FIG. 4 in a contracted adjustment with an internal locking tube.
Figure 7:
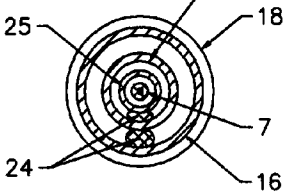
FIG. 7 is a section view taken along line 7—7 of FIG. 4.
Figure 6:
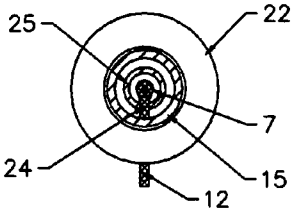
FIG. 6 is a section view taken along line 6—6 of FIG. 4.
Figure 8:
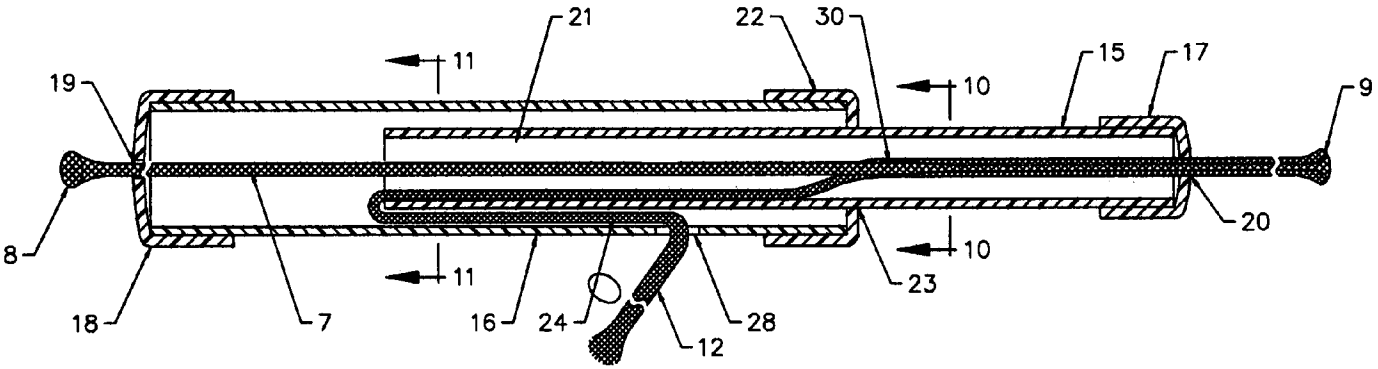
FIG. 8 is a section view of a single standoff mooring bar of this invention in an extended adjustment without an internal locking tube.
Figure 9:
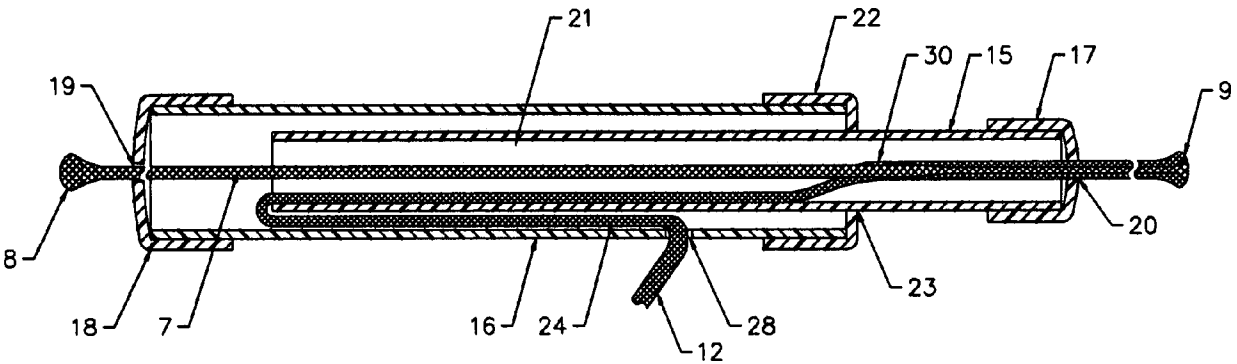
FIG. 9 is a section view which shows the structure of FIG. 8 in a contracted adjustment with an internal locking tube.
Figure 11:
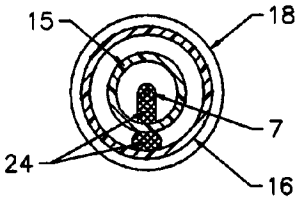
FIG. 11 is a section view taken along line 7—7 of FIG. 8.
Figure 10:
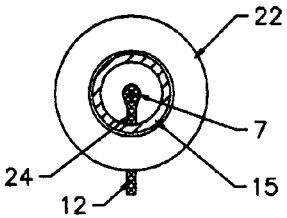
FIG. 10 is a section view taken along line 6—6 of FIG. 8.

As is best shown in FIGS. 4 and 5, a mooring rope 7 passes through the central bore of each mooring bar so that rope tie ends 8 and 9 project out of the device. Tie ends 9 of each bar 1 and 2 are secured to boat cleats 10 and 11, and tie ends 8 are secured to docking posts 5 and 6.

A first guy rope 12 which is the continuation of locking rope 24 extends between mooring bar 1 and docking ring 13, and a second guy rope 12 which is the continuation of locking rope 24 extends between mooring bar 2 and docking ring 14. This arrangement of guy ropes and mooring bars establishes a pair of triangles which prevent boat 3 from swaying relative dock 4.

Mooring bars 1 and 2 have an identical construction which is shown in detail in FIG. 4. Each bar has a body which has a manually adjustable length which is automatically locked at that length when the tie ends and guy rope are secured. The body is formed by telescoping an inner cylindrical tube 15 within outer tube 16. The exposed end of inner tube 15 is permanently closed by end cap 17, and the opposite exposed end of outer tube 16 is permanently closed by end caps 18 and 22. Tubes 15 and 16, and end caps 17, 18 and 22 may be fabricated from polyvinyl chloride, and the end caps glued to their associated tubes. In certain boat mooring situations it may be advisable to use two or more mooring bars having outer tubes 16 of different lengths and/or inner tubes 15 of different lengths.

Each end cap 17 and 18 has a central hole 20 and 19, respectively. Mooring rope 7 passes through holes 19 and 20, and cavity 21 formed by the composite bores of tubes 15 and 16. End cap 22 has a central hole 23 through which tube 15 passes.

The length of each mooring bar 1 and 2 is adjusted as desired for the proper mooring distance by manually varying the extent of telescoping insertion of inner tube 15 within outer tube 16. The selected length is maintained in compression (i.e. against collapsing of the mooring bar, but not against extension of the mooring bar) by the tension in locking rope 24 acting compressively on locking tube 25 and tube 15, and in tension by the tension in rope 7 between the terminations at boat cleats 10 and 11, and at docking posts 5 and 6. Locking tube 25 is seated loosely within inner and outer tubes 15 and 16 and is centered via rope 7. When locking rope 24 is under tension, locking tube 25 is seated against end cap 18 at 27. A hole near the inner end 29 of locking tube 25 forms a fixed rounded edged hole for locking rope 24 to return (or fold) upon itself. This return or fold enables the locking rope to prevent collapsing of the mooring bar as tension is maintained.

The internal portion of locking rope 24 passes through the annular space 21 between cylindrical tubes 15 and 25, around the end in tube 15, and continues out of hole 28 in cylindrical tube 16 and becomes guy rope 12. The tension in locking rope 24 is created and maintained primarily by the termination of guying rope 12 at the dock rings 13 and 14 and the tie ends 8 at docking posts 5 and 6.

The end of mooring rope 7 is inserted into an opening 30 formed between the expanded interstices of locking rope 24 and is passed through the bore of the braid of rope 24. This end is terminated as part of the termination of tie end 8. A pulling force exerted on guying rope 12 extending away from the body of the mooring bar, causes locking rope 24 to seat locking tube 25 against end cap 18 at 27.

Components 24 and 25 comprise an automatic locking assembly which operates as follows during a mooring operation. Initially, tubes 15 and 16 are manually adjusted to the required standoff mooring distance. Thereafter, the exposed end of guying rope 12 (which is also locking rope 24) is manually pulled to seat locking tube 25 as shown in FIG. 4. Tie end 8 is then tied off on docking post 5 or 6, and the opposite end 9 of mooring rope 7 is thereafter placed under tension manually during tie off on cleat 10 or 11. When rope 7 is tensioned at both ends 8 and 9 tubes 15 and 16 are automatically locked against extending; when guying rope 12 is tensioned, tubes 15 and 16 are automatically locked against collapsing.

An alternate method of the locking assembly is shown in FIGS. 8, 9, 10 and 11. The difference is that the composite portion of the central mooring rope passes through end cap 17 through hole 20 rather than through end cap 18 and hole 19. The selected length is maintained in compression by the tension in locking rope 24 acting compressively on tube 15 and in tension by the tension in rope 7 between the terminations at boat cleats 10 and 11, and at docking posts 5 and 6. The inner end of tube 15 forms a fixed rounded edge for locking rope 24 to return (or fold) upon itself. This return or fold enables the locking rope to prevent collapsing of the mooring bar as tension is maintained.

The internal portion of locking rope 24 passes through the composite bore defined by tubes 15 and 16, around the rounded end in tube 15, and continue out of hole 28 in cylindrical tube 16 and becomes guy rope 12. The tension in locking rope 24 is created and maintained primarily by the termination of guying rope 12 at the dock rings 13 and 14 and the tied ends 9 at boat cleats 10 and 11.

The end of mooring rope 7 is inserted into an opening 30 formed between the expanded interstices of locking rope 24 and is passed through the bore of the braid of rope 24. This end is terminated as part of the termination of tie end 9.

Component 24 comprises an automatic locking assembly which operates as follows during a mooring operation. Initially, tubes 15 and 16 are manually adjusted to the required standoff mooring distance. Tie end 9 is then tied off on boat cleats 10 and 11 and the opposite end 8 of mooring rope 7 is thereafter placed under tension manually during tie off on docking posts 5 and 6. When rope 7 is tensioned at both ends 8 and 9 tubes 15 and 16 are automatically locked against extending; when guying rope 12 is tensioned, tubes 15 and 16 are automatically locked against collapsing.

The preferred embodiment previously described is illustrative of the principles of this invention. It should be understood, modifications can be made without departing from the scope of the invention.

What is claimed is:

1. A standoff mooring bar for a craft comprising an adjustable length mooring bar body having an elongated inner cylindrical tube telescoping within an elongated outer cylindrical tube, with each tube defining an elongated bore; a mooring rope extending through the bore of the telescoping pair of cylindrical tubes; and an automatic locking assembly fixing the adjustable length of the telescoping pair of tubes when subjected to a collapsing mooring force, with the locking assembly including a generally cylindrical locking tube housed within a cavity defined by the inner and outer tubes and with the mooring rope also passing through a bore in the locking tube, and a flexible locking rope having one end portion passing through the outer tube creating a guying rope and the other end portion extending through the bore of the locking tube and fixed to the mooring rope so that the tensioning of the mooring rope and the guying rope causes the locking assembly to fix the relative position of the inner and outer tubes to prevent collapsing or extending of the mooring bar.

2. The combination of claim 1 in which the mooring bar is infinitely adjustable lengthwise between its minimum and maximum lengths.

3. A standoff mooring bar for a boat or a float airplane comprising an adjustable length mooring bar body having an elongated inner cylindrical tube telescoping within an elongated outer cylindrical tube, with each tube defining an elongated bore; a mooring rope extending through the bore of the telescoping pair of cylindrical tubes; and an automatic locking assembly fixing the adjustable length of the telescoping pair of tubes when subjected to a collapsing mooring force with the locking assembly including locking-rope guiding means housed within a cavity defined by the inner and outer tubes, and a flexible locking rope having one end portion passing through the outer tube creating a guying rope and the other end portion extending through the rope guiding means with the guiding means forming a fixed point for the locking rope to return upon itself and with the locking rope being fixed to the mooring rope so that the tensioning of the mooring rope and guying rope causes the locking assembly to fix the relative position of the inner and outer tubes to prevent collapsing or extending of the mooring bar.

4. The combination of claim 3 in which the mooring bar is infinitely adjustable lengthwise between its minimum and maximum lengths.

* * * * *